United States Patent [19]

Servadio

[11] Patent Number: 4,512,568

[45] Date of Patent: Apr. 23, 1985

[54] PUNCHING BAG REBOUND ADJUSTER

[76] Inventor: Robert Servadio, 3721 Parkview Ave., Pittsburgh, Pa. 15213

[21] Appl. No.: 481,732

[22] Filed: Apr. 4, 1983

[51] Int. Cl.[3] ..... A63B 69/22

[52] U.S. Cl. ..... 272/78

[58] Field of Search ..... 272/76–78, 272/102; 273/1.5 R, 1, 1.5 A, 29 BB, 29 BC; 128/71

[56] References Cited

U.S. PATENT DOCUMENTS

| | | | |
|---|---|---|---|
| 717,273 | 12/1902 | Reach | 272/78 |
| 1,998,454 | 4/1938 | Gordon | 273/29 BB |
| 2,012,899 | 8/1935 | Thorson | 272/78 |
| 2,534,067 | 12/1950 | Rubin | 272/78 |
| 2,677,545 | 5/1954 | Ross | 272/78 |
| 2,709,082 | 5/1955 | Klaudt | 272/78 |
| 2,961,236 | 11/1960 | Murphy | 273/1.5 R |
| 2,986,395 | 5/1961 | Sheftel | 272/78 |

FOREIGN PATENT DOCUMENTS

| | | | |
|---|---|---|---|
| 2708130 | 8/1978 | Fed. Rep. of Germany | 273/29 BC |
| 0007496 | of 1910 | United Kingdom | 272/78 |

*Primary Examiner*—Richard J. Apley
*Assistant Examiner*—S. R. Crow
*Attorney, Agent, or Firm*—William J. Ruano

[57] ABSTRACT

An electrically operated rebound adjuster for a punching bag, comprising a reversible electric drive motor which rotates a vertically mounted screw threaded spindle or shaft on the lower end of which a punching bag is supported so as to selectively raise or lower the position of the punching bag relative to a horizontal rebound board. Limit controls prevent excessive travel of the shaft in either direction to prevent excessive raising or lowering of the punching bag relative to the rebound board. The rebound board supports the entire control assembly through supporting brackets.

1 Claim, 3 Drawing Figures

PUNCHING BAG REBOUND ADJUSTER

This invention relates to a punching bag rebound adjuster.

An outstanding disadvantage of supporting mechanism for punching bags has been that no suitable vernier adjustments were made possible, or adjustments that were truly maintenance-free as well as easy and speedy to make.

An object of this invention is to provide a novel rebound adjuster for a punching bag which is exceedingly simple and instantaneous to operate, either upwardly or downwardly to shorten or lengthen the swing of the bag and which prevents abnormal adjustments, either in the vertically upward or downward direction.

Another object of the invention is to provide a rigid and practically indestructible mechanism for selectively adjusting a punching bag either upwardly or downwardly of a rebound board within predetermined limits and which has relatively long life.

Other objects and advantages of the invention will become more apparent from a study of the following description, taken with the accompanying drawing wherein.

Figure 1:
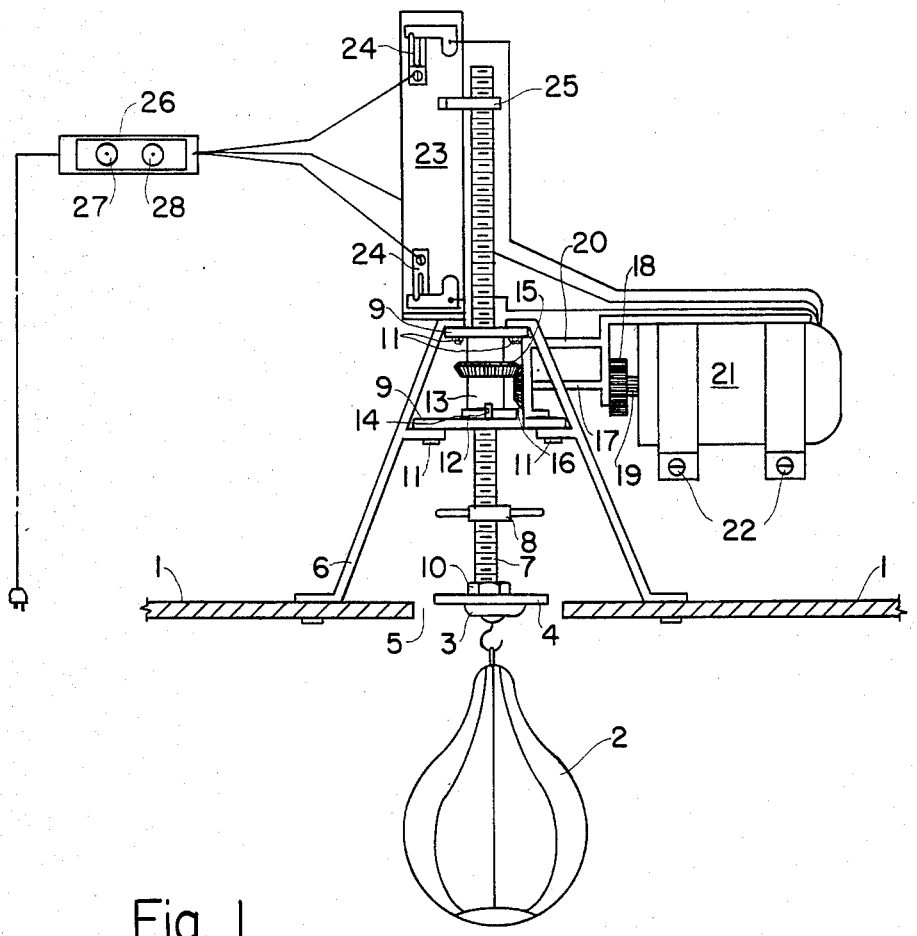
FIG. 1 is an elevational view of a punching bag rebound adjuster embodying the principles of the present invention.

Referring more particularly to the drawings, numeral 1 denotes a rebound board for a punching bag 2 which is suspended by a hook or eye from a swivel 3, swivel mounting plate 4 and locking nut 10 to enable the punching bag to be adjustably swiveled about threaded shaft 7 and then locked in place by nut 10 in the space 5 cut out of the center of a rebound board 1.

Three mounting legs 6, rigidly fastened to the rebound board 1 serve as supports for sleeve 13 mounted on a bushing 12 having an anti-rotation key 14.

Figure 2:
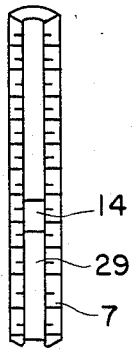
FIG. 2 is a fragmentary view of the elevator shaft 7, more clearly showing the anti-rotation channel therein, and anti-rotation key which fits in the channel.

A bevel drive gear 15 is internally screw threaded to shaft 7 and selectively raising or lowering the elevator shaft 7. The elevator shaft 7 is kept from turning or rotation by anti-rotation key 14 that rides in anti-rotation channel 29 machined into the elevator shaft as shown in FIG. 2. Wing nut 8 locks shaft 7 after adjustments.

Bevel drive gear 15 is driven by a bevel gear 16 driven by a shaft 17 and gear 18 which, in turn, is driven by a pinion drive gear 19. The gears described are supported on a drive train frame and mounting bracket 20. The gear train is driven by a reversible universal motor 21 supported by motor mounting straps 22 from frame 20.

A circuit breaker mounting panel 23 is provided with circuit breakers 24, 24 which are tripped by circuit breaker trip lever 25 which is propelled upwardly or downwardly along the threads of the elevator shaft 7.

An operating switchbox 26 is provided with control buttons 27 and 28.

Figure 3:
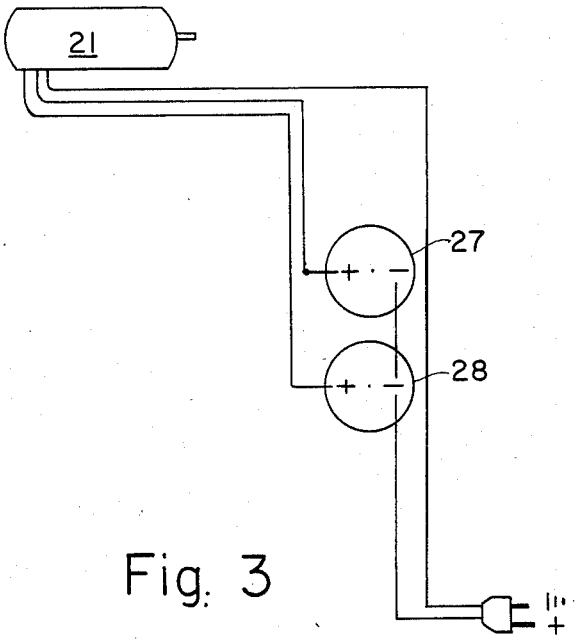
FIG. 3 is a circuit diagram of the electrical control system shown in FIG. 1.

Referring to FIG. 3, in operation, when the "up" button 27 is pushed to complete the circuit and allow rotation of the driving motor 21 in the direction so as to raise the punching bag to shorten its swing, such raising adjustment will be continued until switch 27 is released so as to break the circuit. When it is desired to lower the height of the bag 2 relative to the rebound board 1 to obtain a longer arc of swing of the bag 2, the "down" switch 28 is depressed which will effect rotation of the motor 21 to move bag 2 in a downward direction until the button is released.

In the course of upward movement or adjustment of the punching bag 2, if the adjustment is abnormal, trip lever 25 will contact the upper trip switch 24 and break the circuit so as to stop rotation of motor 21. Likewise, if the circuit breaker trip lever 25 is moved downwardly beyond a desired limit, it will contact and trip the lower circuit breaker 24 and interrupt the circuit so as to stop the motor drive and further downward movement of the punching bag 2.

Of course, in some instances the circuit breaker trip lever 25 and circuit breakers 24 may be omitted if not deemed important for a specific application.

Thus it will be seen that I have provided a highly efficient and easily and quickly operated control mechanism for selectively raising or lowering a punching bag relative to a rebound board and which is capable of making vernier adjustments almost instantly by the mere pressing of a control button; furthermore, I have provided a highly efficient, electrically operated drive for moving an elevator shaft in opposite directions to selectively effect upward or downward movement of the punching bag, at will, and which is of very rigid and durable construction and practically maintenance-free.

While I have illustrated and described a single specific embodiment of my invention, it will be understood that this is by way of illustration only and that various changes and modifications may be contemplated in my invention within the scope of the following claims.

I claim:

1. In combination with a rebound board, having a central hole, a punching bag, mounting means including mounting legs supported on said rebound board and surrounding said central hole, for suspending said punching bag from said rebound board through said central hole, including adjusting means comprising a vertically mounted threaded shaft, from the lower end of which said punching bag is suspended, coaxially with said shaft, said hole being sufficiently large to allow the top portion of said punching bag to project therethrough, reversible driving motor means, including control buttons and circuit breakers mounted on a panel supported on said mounting means and responsive to a trip lever propelled along said vertically mounted threaded shaft for driving a bevel gear internally screw threaded to said vertical shaft to effect selective lifting or lowering of said vertical shaft in response to rotation of said driving motor means in one direction or in an opposite direction to adjust the distance between the rebound board and punching bag.

* * * * *